US010124213B2

(12) United States Patent
Nardacci et al.

(10) Patent No.: US 10,124,213 B2
(45) Date of Patent: Nov. 13, 2018

(54) NON-CIRCULAR GOLF BALL DIMPLE PLAN SHAPES AND METHODS OF MAKING SAME

(71) Applicant: Acushnet Company, Fairhaven, MA (US)

(72) Inventors: Nicholas M. Nardacci, Marion, MA (US); Michael R. Madson, Wrentham, MA (US); Chris Hixenbaugh, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/942,111

(22) Filed: Nov. 16, 2015

(65) Prior Publication Data

US 2017/0136304 A1 May 18, 2017

(51) Int. Cl.
*A63B 37/00* (2006.01)
*A63B 37/14* (2006.01)

(52) U.S. Cl.
CPC ..... *A63B 37/0006* (2013.01); *A63B 37/0004* (2013.01); *A63B 37/0007* (2013.01); *A63B 37/0008* (2013.01)

(58) Field of Classification Search
CPC ..... A63B 37/0004; A63B 37/0007; A63B 37/0008
See application file for complete search history.

(56) References Cited

U.S. PATENT DOCUMENTS

| | | | | |
|---|---|---|---|---|
| 5,377,989 | A * | 1/1995 | Machin | A63B 37/0004 40/327 |
| 5,566,943 | A | 10/1996 | Boehm | 473/384 |
| 6,019,688 | A * | 2/2000 | Sullivan | A63B 37/0004 473/383 |
| 6,729,976 | B2 | 5/2004 | Bissonnette et al. | 473/383 |
| 6,796,912 | B2 | 9/2004 | Dalton et al. | 473/383 |
| 8,974,320 | B2 | 3/2015 | Sato et al. | 473/384 |
| 2002/0077198 | A1* | 6/2002 | Sajima | A63B 37/0004 473/378 |
| 2003/0158002 | A1* | 8/2003 | Morgan | A63B 37/0004 473/383 |
| 2009/0111613 | A1* | 4/2009 | Sato | A63B 37/0007 473/383 |
| 2010/0093468 | A1* | 4/2010 | Sato | A63B 37/0004 473/383 |
| 2011/0111887 | A1* | 5/2011 | Sullivan | A63B 37/0004 473/383 |
| 2012/0165130 | A1 | 6/2012 | Madson et al. | 473/384 |
| 2012/0302378 | A1* | 11/2012 | Sato | A63B 37/0006 473/384 |

(Continued)

OTHER PUBLICATIONS

U.S. Appl. No. 14/941,807 entitled "Golf Ball Dimple Plan Shapes and Methods of Making Same".

(Continued)

*Primary Examiner* — John E Simms, Jr.
(74) *Attorney, Agent, or Firm* — Mandi B. Milbank

(57) ABSTRACT

The present invention is directed to a golf ball that includes at least a portion of its dimples having a plan shape defined by superposed curves. In addition, the present invention is directed to golf balls having improved aerodynamic performance due, at least in part, to the selection of the dimple plan shapes and resulting dimple patterns.

5 Claims, 13 Drawing Sheets

(56) References Cited

U.S. PATENT DOCUMENTS

| | | | | |
|---|---|---|---|---|
| 2013/0172123 | A1 | 7/2013 | Nardacci et al. | 473/383 |
| 2014/0128179 | A1* | 5/2014 | Kim | A63B 37/0006 473/383 |
| 2015/0119171 | A1 | 4/2015 | Madson et al. | |

OTHER PUBLICATIONS

U.S. Appl. No. 14/941,841 entitled "Golf Ball Dimple Plan Shapes and Methods of Generating Same".
U.S. Appl. No. 12/976,109 entitled "Golf Ball Dimples Defined by Superposed Curves".

* cited by examiner

NON-CIRCULAR GOLF BALL DIMPLE PLAN SHAPES AND METHODS OF MAKING SAME

FIELD OF THE INVENTION

The present invention relates to dimple plan shapes that are non-circular and allow for improved control and flexibility in designing dimple patterns for use on a golf ball. In addition, the dimple plan shapes of the present invention provide improved packing efficiency and finished golf balls having improved aerodynamic characteristics. In particular, the present invention relates to golf ball dimples having a plan shape defined by superposed curves.

BACKGROUND OF THE INVENTION

Golf balls generally include a spherical outer surface with a plurality of dimples formed thereon. The dimples on a golf ball improve the aerodynamic characteristics of a golf ball and, therefore, golf ball manufacturers have researched dimple patterns, shape, volume, and cross-section in order to improve the aerodynamic performance of a golf ball. Determining specific dimple arrangements and dimple shapes that result in an aerodynamic advantage requires an understanding of how a golf ball travels through the air.

Aerodynamic forces acting on a golf ball are typically resolved into orthogonal components of lift ($F_L$) and drag ($F_D$). Lift is defined as the aerodynamic force component acting perpendicular to the flight path. It results from a difference in pressure that is created by a distortion in the air flow that results from the back spin of the ball. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Drag is defined as the aerodynamic force component acting opposite to the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. The air separates from the surface of the ball, leaving a large turbulent flow area with low pressure, i.e., the wake. The difference between the high pressure in front of the ball and the low pressure behind the ball reduces the ball speed and acts as the primary source of drag.

Lift and drag, among other aerodynamic characteristics of a golf ball, are influenced by the external surface geometry of the ball, which includes the dimples thereon. As such, the dimples on a golf ball play an important role in controlling those parameters. For example, the dimples on a golf ball create a turbulent boundary layer around the ball, i.e., the air in a thin layer adjacent to the ball flows in a turbulent manner. The turbulence energizes the boundary layer and helps it stay attached further around the ball to reduce the area of the wake. This greatly increases the pressure behind the ball and substantially reduces the drag.

Accordingly, the design variables associated with the external surface geometry of a golf ball, e.g., surface coverage, dimple pattern layout, and individual dimple geometries, provide golf ball manufacturers the ability to control and optimize ball flight. However, any adjustments to dimple geometry in an attempt to optimize aerodynamic characteristics have been limited to dimple profile. While the dimple profile has been used by manufacturers in an attempt to affect the aerodynamic performance of the golf ball, the dimple plan shape has remained largely circular in nature. Circular perimeters, however, limit packing efficiency and the number of dimple counts that are achievable for a particular polyhedral base geometry. While non-circular dimple plan shapes have been discussed as alternatives to circular perimeters, see, e.g., U.S. Pat. No. 8,974,320, such discussion is limited to polygonal, teardrop, or elliptical dimples, which still limits surface coverage uniformity and packing efficiency. Accordingly, there remains a need for a dimple plan shape that results in a maximized surface coverage uniformity and packing efficiency, while maintaining desirable aerodynamic characteristics.

SUMMARY OF THE INVENTION

The present invention is directed to a golf ball having a substantially spherical surface, including: a plurality of dimples on the spherical surface, wherein at least a portion of the plurality of dimples include a non-circular plan shape defined by the superposition of at least a first element and a second element. In one embodiment, the first and second elements are plane curves selected from the group consisting of circular curves, elliptical curves, polygonal curves, periodic curves, algebraic polar curves, and asteroid curves. In another embodiment, the first and second elements are different. For example, the first element is a periodic curve and the second element is a different periodic curve. The plane curves may independently be continuous, piecewise continuous, or discontinuous.

In this aspect of the invention, the first and second elements maintain a central axis that is coincident with the center of a dimple. In another embodiment, the golf ball may further include a third element that is different from the first and second elements, and wherein the third element is a plane curve selected from the group consisting of circular curves, elliptical curves, polygonal curves, periodic curves, algebraic polar curves, and asteroid curves. In yet another embodiment, the at least a portion includes about 50 percent or more of the dimples on the golf ball.

The present invention is also directed to a golf ball having a substantially spherical surface, including: a plurality of dimples on the spherical surface, wherein at least a portion of the plurality of dimples include a non-circular plan shape defined by the superposition of three or more different curves selected from the group consisting of circular curves, elliptical curves, polygonal curves, periodic curves, algebraic polar curves, and asteroid curves. In one embodiment, each of the three or more different curves is independently continuous, piecewise continuous, or discontinuous. In another embodiment, at least one of the three or more different curves is a discontinuous curve. In still another embodiment, at least one of the three or more different curves is a continuous curve. In yet another embodiment, at least one of the three or more different curves is a piecewise continuous curve.

In this aspect, the three or more different curves are of the same path type selected from the group consisting of continuous, piecewise continuous, and discontinuous. In another embodiment, at least two of the three or more different curves are of different path types selected from the group consisting of continuous, piecewise continuous, and discontinuous. In still another embodiment, at least three of the different curves are of different path types selected from the group consisting of continuous, piecewise continuous, and discontinuous. In yet another embodiment, the curves may maintain a central axis that is coincident with the center of a dimple.

The present invention is further directed to a golf ball dimple having a perimeter defined by the superposition of a first element and a second element, wherein first and second elements are independently (i) continuous, piecewise continuous, or discontinuous, (ii) selected from the group consisting of curves, splines, and functions, and (iii) maintain a central axis that is coincident with the center of a dimple, and wherein the first and second elements are different. In one embodiment, at least one of the first and second elements is a continuous curve. In another embodiment, at least one of the first and second elements is a piecewise continuous curve. In still another embodiment, the second element may be a continuous curve. In yet another embodiment, the golf ball dimple further includes a third element that is different from the first and second elements and maintains a central axis that is coincident with the center of a dimple, wherein the third element is selected from the group consisting of curves, splines, and functions. In still another embodiment, the third element is a continuous curve.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
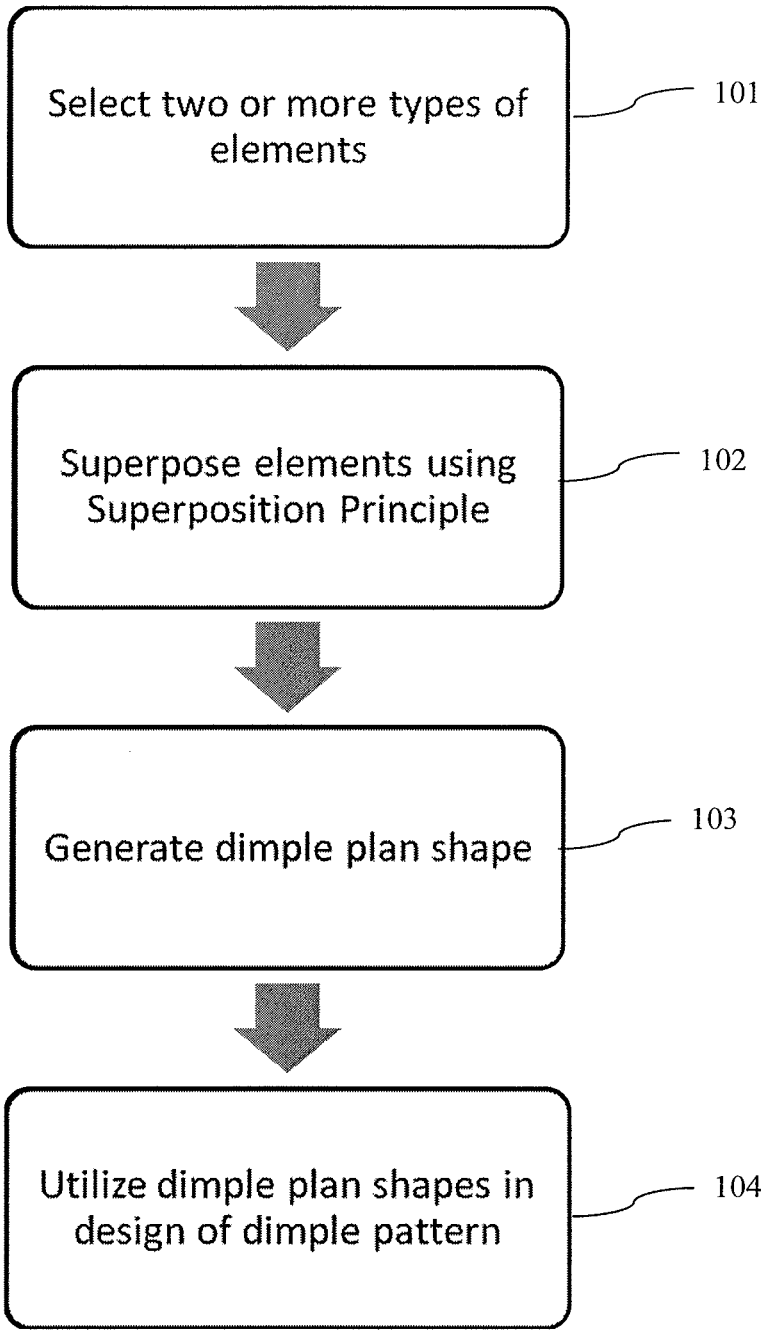
FIG. 1 is a flow chart illustrating the steps of designing a dimple plan shape suitable for use in a dimple pattern according to the present invention.

The present invention is directed to golf ball dimples having non-circular plan shapes. In particular, the present invention is directed to golf ball dimples having a plan shape defined by superposed curves. The present invention is also directed to the use of one or more of the non-circular dimples in a dimple pattern applied to a golf ball.

Advantageously, the non-circular dimples of the present invention allow for greater control and flexibility in defining the resulting dimple geometry. In particular, a dimple pattern formed in accordance with the present invention provides improved packing efficiency and uniformity of surface coverage. For example, when dimple shapes or boundaries of the golf ball are circular, the packing efficiency and number of the dimples is limited. Since a number of different dimple plan shapes are possible using the present invention, the present invention, in turn, provides for greater control and flexibility when designing the dimple pattern. Moreover, the dimple plan shapes and dimple patterns described herein allow for golf ball surface textures with unique appearances.

Furthermore, based on the greater control and flexibility in dimple patterns, the finished golf ball may have improved aerodynamic performance due, at least in part, to the selection of the dimple plan shapes and resulting dimple patterns. In particular, the present invention provides a golf ball manufacturer the ability to fine tune golf ball aerodynamic characteristics by controlling the external surface geometry of the dimple and resulting dimple pattern. Specifically, since the perimeter or boundary of each dimple allows dimples to create the turbulence in the boundary layer, "micro" adjusting the dimple plan shapes in accordance with the present invention, allow for further agitation or energizing of the turbulent flow over the dimples. This, in turn, reduces the tendency for separation of the turbulent boundary layer around the golf ball in flight.

Dimple Plan Shapes

A dimple plan shape, as used herein, refers to the perimeter of the dimple as seen from a top view of the dimple, or the demarcation between the dimple and the outer surface of the golf ball or fret surface. The present invention contemplates dimples having a non-circular plan shape defined by the superposition of two or more curves.

According to the present invention, the plan shape of at least one dimple is formed by the superposition of two or more elements. The Superposition Principle states that if $y_1(x)$ and $y_2(x)$ yield valid solutions, then the sum of $y_1(x)$ and $y_2(x)$ will also yield a valid solution. For example, the Superposition Principle states that when two waves interfere, the resulting displacement of the medium at any location will be the algebraic sum of the displacements of the individual waves at that same location. By applying this principle, two or more elements may be combined to create a unique dimple plan shape.

In this aspect, the superposition of various elements is used to define the plan shapes of dimples in accordance with the present invention. Non-limiting elements include lines, curves, splines, and functions. For example, the present invention contemplates dimples formed from the superposition of various plane curves. By the term, "plane curve," it is meant an open or closed curve that lies in a single plane. In this aspect, elements suitable for use in accordance with the present invention include, but are not limited to, circular curves, elliptical curves, polygonal curves, algebraic polar curves, and asteroid curves. Star polygons, such as five, six, eight, and ten-point periodic stars, pentagons, hexagons, heptagons, octagons, nonagons, and decagons, are also contemplated for use as suitable elements in accordance with the present invention.

In one embodiment, the element is a spline. By the term, "spline," it is meant a numeric function that is piecewise-defined by polynomial functions. For example, a suitable element for forming a dimple plan shape in accordance with the present invention may be a cubic spline, which is a spline constructed of piecewise third-order polynomials.

Non-limiting examples of the various functions contemplated by the present invention for use as an element include, but are not limited to, periodic functions and algebraic functions. In one embodiment, a suitable function for forming a dimple plan shape in accordance with the present invention is a periodic function. By the term, "periodic function," it is meant a function that repeats its values at regular intervals or periods. Examples of periodic functions include, but are not limited to, sine, cosine, tangent, triangle wave, sawtooth wave, and square wave functions. Indeed, any non-constant function is suitable in this aspect of the invention. As will be apparent to one of ordinary skill in the art, constant functions in the form of $f(x)=c$, where c is a constant, do not change the general appearance of the plan shape when the constant function is superposed with a different function, and thus are not contemplated by the present invention.

In another embodiment, the element may be a low frequency periodic function defined along a simple closed path, as described in U.S. application Ser. No. 14/941,841, entitled "Golf Ball Dimple Plan Shapes and Methods of Generating Same," the entire disclosure of which is incorporated by reference herein. In another embodiment, the element may be a high frequency periodic function defined along a simple closed path, as described in U.S. application Ser. No. 14/941,807, entitled "Golf Ball Dimple Plan Shapes and Methods of Making Same," the entire disclosure of which is incorporated by reference herein.

According to the present invention, the path of the various elements used to form the plan shapes of dimples may vary. However, the path of the element should maintain a central axis that is coincident with the center of the dimple. In one embodiment, the path of the element may be continuous. For example, the path of the element is said to be continuous if it is continuous at every point of its domain. In this aspect, the continuous path contemplated by the present invention includes a simple closed path. A "simple closed path," as used herein, includes one that starts and ends at the same point without traversing any defining point or edge along the path more than once. In another embodiment, the path of the element may be piecewise continuous. In this aspect, the path of the element may be made up of continuous pieces. In yet another embodiment, the path of the element may be discontinuous. In this aspect, the path of the element may have a removable discontinuity (e.g., a hole) or a non-removable discontinuity (e.g., a jump or an asymptote).

The present invention contemplates forming dimple plan shapes defined by the superposition of at least two of the elements discussed above. In one embodiment, the present invention contemplates forming dimple plan shapes defined by the superposition of three or more elements. In another embodiment, the present invention contemplates forming dimple plan shapes defined by the superposition of four or more elements. In yet another embodiment, the present invention contemplates forming dimple plan shapes defined by the superposition of five or more elements.

In this regard, the dimple plan shapes of the present invention may be defined by the superposition of any combination of elements discussed above. Indeed, the dimple plan shapes of the present invention may be defined by the superposition of any combination of two or more different lines, curves, splines, or functions as described above. The two or more lines, curves, splines, or functions may be continuous, piecewise continuous, or discontinuous. In this aspect, each of the two or more lines, curves, splines, or functions should be different such that the superposition of the elements creates an alternative shape. For example, in one embodiment, the dimple plan shape may be defined by the superposition of a continuous first element and a continuous second element, where the second element and the first element differ. In another embodiment, the dimple plan shape may be defined by a piecewise continuous first element and a piecewise continuous second element, where the second element and the first element differ. In yet another embodiment, the dimple plan shape may be defined by a continuous first element and a piecewise continuous second element. In still another embodiment, the dimple plan shape may be defined by a discontinuous first element and a discontinuous second element, where the second element and the first element differ. In still another embodiment, the dimple plan shape may be defined by a continuous first element and a discontinuous second element, where the second element and the first element differ. In yet another embodiment, the dimple plan shape may be defined by a piecewise continuous first element and a discontinuous second element.

This general approach may extend to more than two elements. For example, in one embodiment, the dimple plan shape may be defined by the superposition of a continuous first element, a continuous second element, and a continuous third element, where the first, second, and third elements differ from each other. In another embodiment, the dimple plan shape may be defined by a piecewise continuous first element, a piecewise continuous second element, and a piecewise continuous third element, where the first, second, and third elements differ from each other. In yet another embodiment, the dimple plan shape may be defined by a continuous first element, a piecewise continuous second element, and a continuous third element, where the first and third elements differ. In still another embodiment, the dimple plan shape may be defined by a discontinuous first element, a discontinuous second element, and a discontinuous third element where the first, second, and third elements differ. In still another embodiment, the dimple plan shape may be defined by a continuous first element, a discontinuous second element, and a discontinuous third element, where the second and third elements differ. In yet another embodiment, the dimple plan shape may be defined by a piecewise continuous first element, a piecewise continuous second element, and a discontinuous second element, where the first and second elements differ.

In this aspect, a suitable dimple plan shape in accordance with the present invention may be defined by the superposition of a continuous ten-point periodic star and a continuous six-point periodic star. In another embodiment, the dimple plan shape may be defined by the superposition of a continuous circle, a continuous ten-point periodic star, and a continuous ellipse. In still another embodiment, the dimple plan shape may be defined by the superposition of a five-point discontinuous star and a continuous circle. In yet another embodiment, the dimple plan shape may be defined by the superposition of a five-point discontinuous star and a discontinuous pentagon. Indeed, a number of different plan shapes are possible through the superposition of the elements described above.

Accordingly, by superposing at least two different continuous, continuous piecewise, and discontinuous elements, the present invention provides for golf ball dimples having various plan shapes defined by superposed curves.

FIG. 1 illustrates one embodiment of a method of forming a dimple plan shape in accordance with the present invention. For example, prior to forming the dimple plan shape, step 101 includes selecting the desired elements to be superposed. In this aspect, two or more curves may be selected such that the curves may be superposed. In one embodiment, the two or more curves are different curves. In another embodiment, each of the paths of the curves may be continuous, such as a continuous simple closed path, piecewise continuous, or discontinuous. Indeed, any of the elements disclosed above are contemplated in this aspect of the invention.

In step 102, the selected elements are superposed to create an alternative shape. As explained above, the Superposition Principle holds that two or more solutions to an equation or set of equations can be added together so that their sum is also a solution. In this aspect, an alternative shape can be formed by adding together the equations of the selected elements. For example, if the desired elements include a circle, a ten-point periodic star, and an ellipse, the alternative shape (step 103), formed by the superposition of these three elements, is defined by the sum of the circular curve, the ten-point periodic star curve, and the elliptical curve.

After the dimple plan shape has been generated, at step 104, the plan shape can be used in designing geometries for dimple patterns of a golf ball. For example, the plan shape paths generated by the methods of the present invention can be imported into a CAD program and used to define dimple geometries and tool paths for fabricating tooling for golf ball manufacture. The various dimple geometries produced in accordance with the present invention can then be used in constructing a dimple pattern that maximizes surface coverage uniformity and dimple packing efficiency. The resulting dimple pattern may then be applied to the outer surface of a golf ball. Similarly, the negative of the resulting dimple pattern may be used to form the interior surface of the cavity of a golf ball mold.

Golf ball dimple patterns using plan shapes produced in accordance with the present invention can be modified in a number of ways to alter ball flight path and the associated lift and drag characteristics. The plan shapes of the present invention can be scaled and/or weighted according to proximity to neighboring dimples. For example, the plan shapes of the present invention may be enlarged or reduced based on the neighboring dimples in order to allow for greater dimple packing efficiency. Likewise, the profile can be 'micro' altered to tailor desired dimple volume, edge angle, or dimple depth to optimize flight performance.

Dimple Patterns & Packing

The golf ball dimple plan shapes of the present invention may be tailored to maximize surface coverage uniformity and packing efficiency by altering the shape based on neighboring dimples. For example, dimples having plan shapes according to the present invention can be designed such that the dimples are packed more closely together to reduce the width of the land portions adjacent to each dimple. In another embodiment, plan shapes according to the present invention can be designed to ensure that the land surface between dimples is more uniform in nature. Thus, the dimples of the present invention allow for maximizing and/or optimizing the dimple coverage and uniformity to improve flight performance.

Figure 10A:
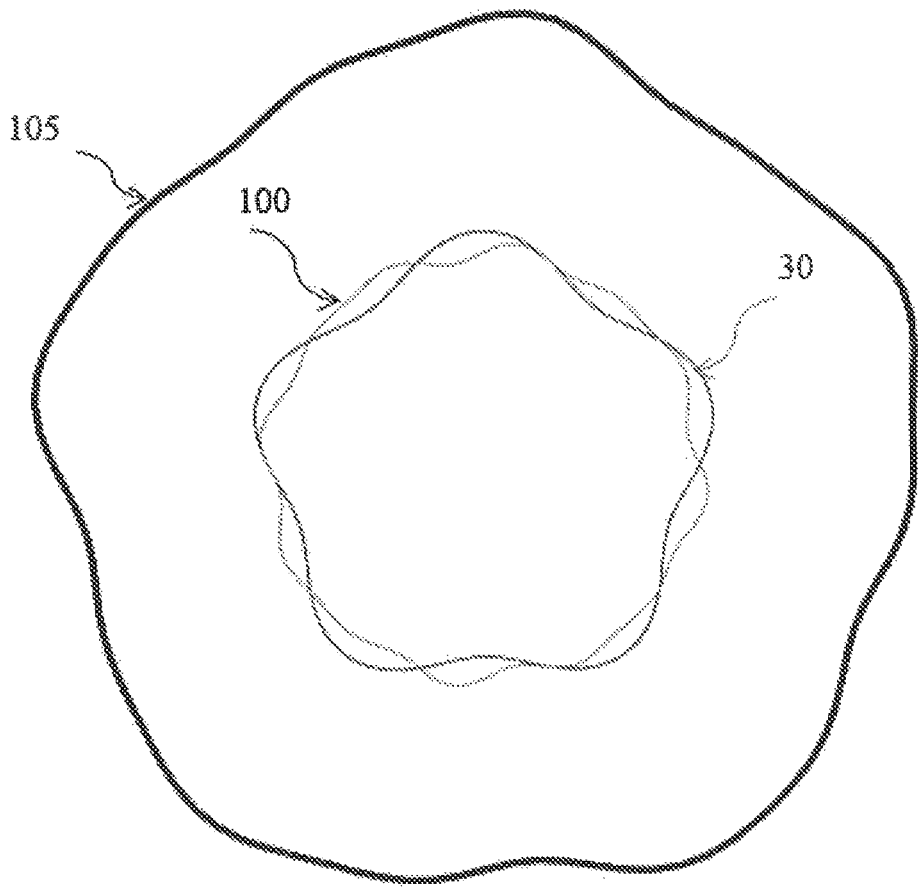
FIG. 10A illustrates a golf ball dimple plan shape defined by the superposition of a five-point periodic star and a periodic saw tooth function.
Figure 10B:
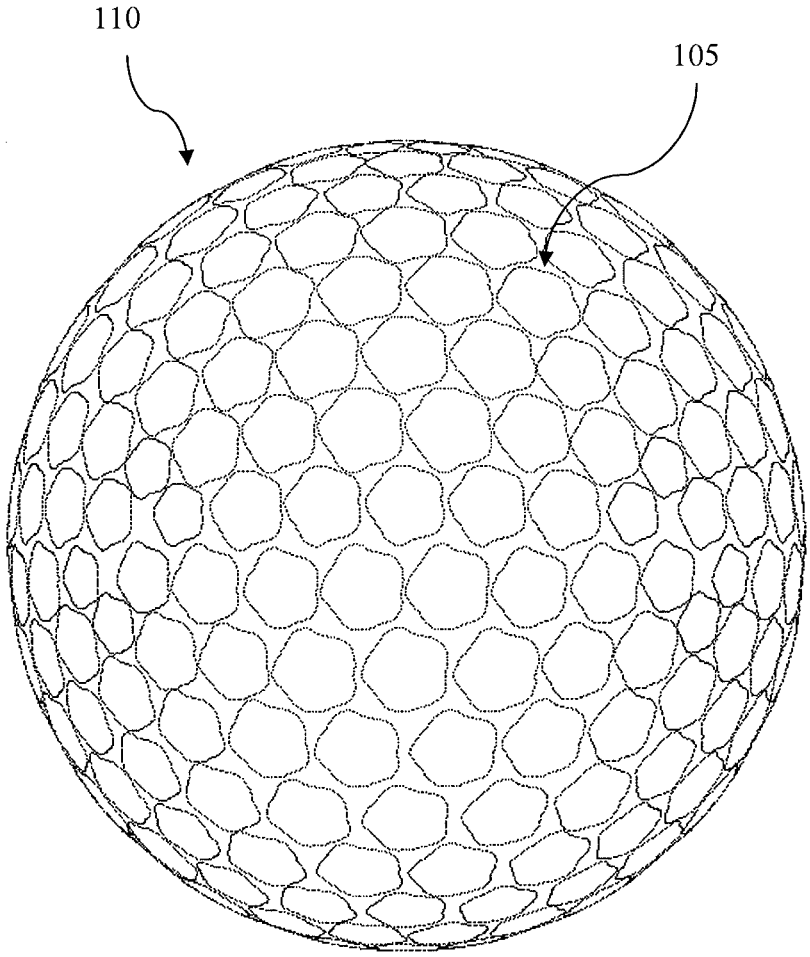
FIG. 10B illustrates a golf ball dimple pattern generated from the superposed plan shape of FIG. 10A.

FIG. 10B shows an illustrative example of a dimple pattern created in accordance with the present invention. In particular, FIG. 10B illustrates a golf ball dimple pattern 110 made up of dimple plan shapes generated from the superposition of a five-point periodic star and a periodic saw tooth function (represented by 105). As demonstrated in FIG. 10B, the present invention provides for the possibility of interdigitation amongst neighboring dimples, a characteristic not possible with conventional circular dimples. This creates the opportunity for additional dimple packing arrangements and dimple distribution on the golf ball surface.

While the plan shapes of the present invention may be used for at least a portion of the dimples on a golf ball, it is not necessary that the plan shapes be used on every dimple of a golf ball. In general, it is preferred that a sufficient number of dimples on the ball have plan shapes according to the present invention so that the aerodynamic characteristics of the ball may be altered. For example, at least about 30 percent of the dimples on a golf ball include plan shapes according to the present invention. In another embodiment, at least about 50 percent of the dimples on a golf ball include plan shapes according to the present invention. In still another embodiment, at least about 70 percent of the dimples on a golf ball include plan shapes according to the present invention. In yet another embodiment, at least about 90 percent of the dimples on a golf ball include the plan shapes of the present invention. Indeed, 100 percent of the dimples on a golf ball may include the plan shapes of the present invention.

While the present invention is not limited by any particular dimple pattern, dimples having plan shapes according to the present invention are arranged preferably along parting lines or equatorial lines, in proximity to the poles, or along the outlines of a geodesic or polyhedron pattern. Conventional dimples, or those dimples that do not include the plan shapes of the present invention, may occupy the remaining spaces. The reverse arrangement is also suitable. Suitable dimple patterns include, but are not limited to, tetrahedron, octahedron, hexahedron, dodecahedron, icosahedron among other polyhedrons.

Dimple Dimensions

The dimples on the golf balls of the present invention may comprise any width, depth, depth profile, edge angle, or edge radius and the patterns may comprise multitudes of dimples having different widths, depths, depth profiles, edge angles, or edge radii.

Since the plan shape perimeters of the present invention are noncircular, the plan shapes are defined by an effective dimple diameter which is twice the average radial dimension of the set of points defining the plan shape from the plan shape centroid. For example, in one embodiment, dimples according to the present invention have an effective dimple diameter within a range of about 0.005 inches to about 0.300 inches. In another embodiment, the dimples have an effective dimple diameter of about 0.020 inches to about 0.250 inches. In still another embodiment, the dimples have an effective dimple diameter of about 0.100 inches to about 0.225 inches. In yet another embodiment, the dimples have an effective dimple diameter of about 0.125 inches to about 0.200 inches.

The surface depth for dimples of the present invention is within a range of about 0.003 inches to about 0.025 inches. In one embodiment, the surface depth is about 0.005 inches to about 0.020 inches. In another embodiment, the surface depth is about 0.006 inches to about 0.017 inches.

The dimples of the present invention also have a plan shape area. By the term, "plan shape area," it is meant the area based on a planar view of the dimple plan shape, such that the viewing plane is normal to an axis connecting the center of the golf ball to the point of the calculated surface depth. In one embodiment, dimples of the present invention have a plan shape area ranging from about 0.0025 $in^2$ to about 0.045 $in^2$. In another embodiment, dimples of the present invention have a plan shape area ranging from about 0.005 $in^2$ to about 0.035 $in^2$. In still another embodiment, dimples of the present invention have a plan shape area ranging from about 0.010 $in^2$ to about 0.030 $in^2$.

Figure 11A:
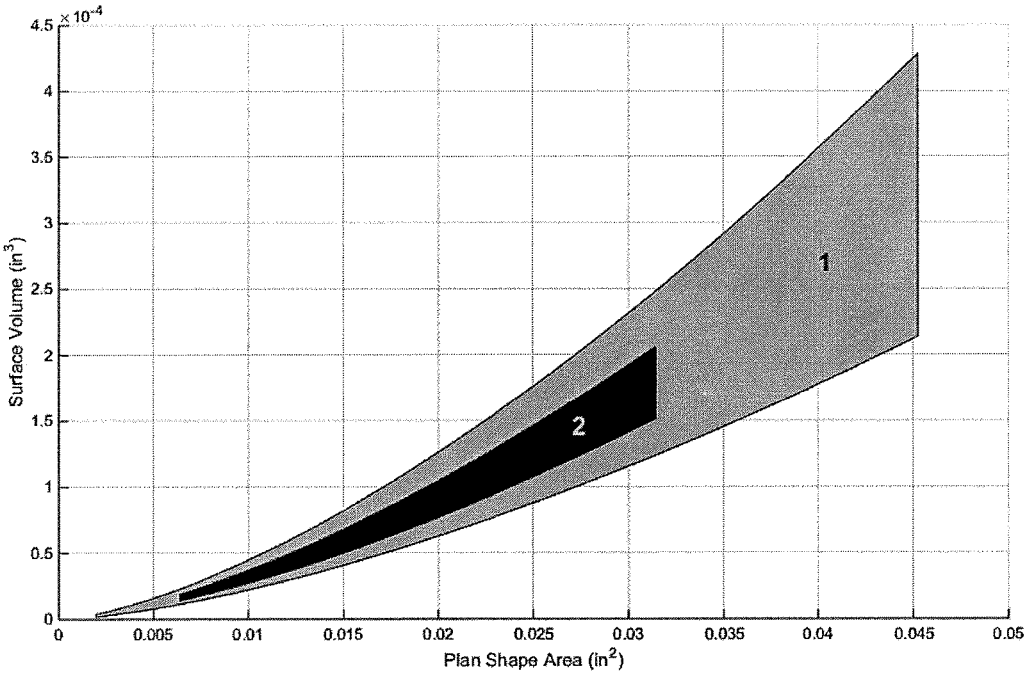
FIG. 11A is a graphical representation illustrating dimple surface volumes for golf balls produced in accordance with the present invention.
Figure 11B:
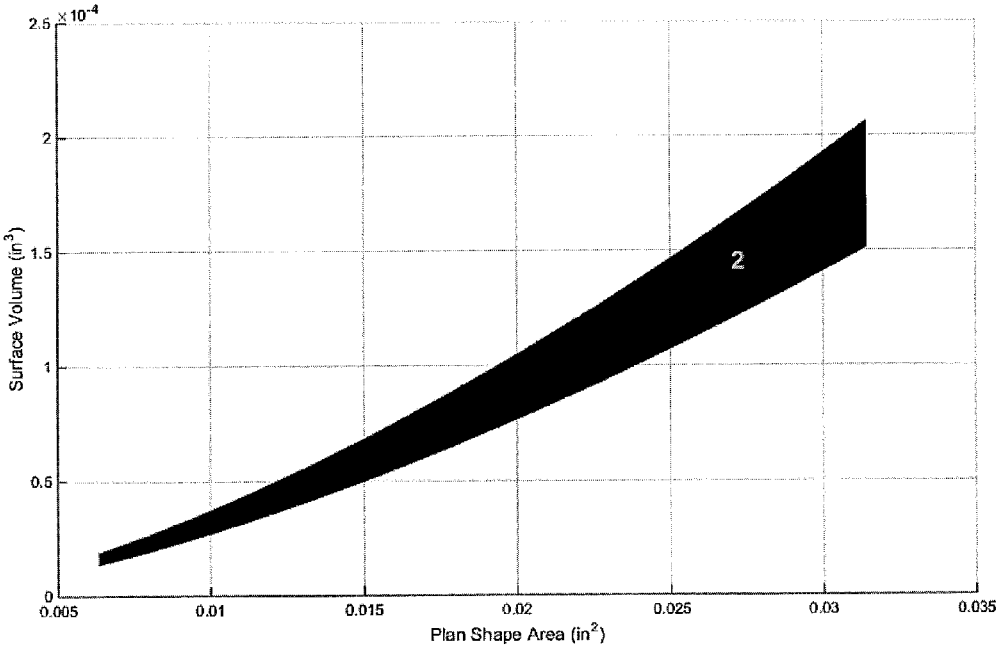
FIG. 11B is a graphical representation illustrating preferred dimple surface volumes for golf balls produced in accordance with the present invention.

Further, dimples of the present invention have a dimple surface volume. By the term, "dimple surface volume," it is meant the total volume encompassed by the dimple shape and the surface of the golf ball. FIGS. 11A and 11B illustrate graphical representations of dimple surface volumes contemplated for dimples produced in accordance with the present invention. For example, FIGS. 11A and 11B demonstrate contemplated dimple surface volumes over a range of plan shape areas. In one embodiment, dimples produced in accordance with the present invention have a plan shape area and dimple surface volume falling within the ranges shown in FIG. 11A. For example, a dimple having a plan shape area of about 0.01 $in^2$ may have a surface volume of about $0.20\times10^{-4}$ $in^3$ to about $0.50\times10^{-4}$ $in^3$. In another embodiment, a dimple having a plan shape area of about 0.025 $in^2$ may have a surface volume of about $0.80\times10^{-4}$ $in^3$ to about $1.75\times10^{-4}$ $in^3$. In still another embodiment, a dimple having a plan shape area of about 0.030 $in^2$ may have a surface volume of about $1.20\times10^{-4}$ $in^3$ to about $2.40\times10^{-4}$ $in^3$. In yet another embodiment, a dimple having a plan shape area of about 0.045 $in^2$ may have a surface volume of about $2.10\times10^{-4}$ $in^3$ to about $4.25\times10^{-4}$ $in^3$.

In another embodiment, dimples produced in accordance with the present invention have a plan shape area and dimple surface volume falling within the ranges shown in FIG. 11B. For example, a dimple having a plan shape area of about 0.01 $in^2$ may have a surface volume of about $0.25\times10^{-4}$ $in^3$ to about $0.35\times10^{-4}$ $in^3$. In another embodiment, a dimple having a plan shape area of about 0.025 $in^2$ may have a surface volume of about $1.10\times10^{-4}$ $in^3$ to about $1.45\times10^{-4}$ $in^3$. In yet another embodiment, a dimple having a plan shape area of about 0.030 $in^2$ may have a surface volume of about $1.40\times10^{-4}$ $in^3$ to about $1.90\times10^{-4}$ $in^3$.

Dimple Profile

Any dimple profile, i.e., the cross-sectional profile, may be used in accordance with the present invention. The cross-sectional profile of the dimples according to the present invention may be based on any known dimple profile. In one embodiment, the cross-sectional profile of the dimple corresponds to a curve. For example, a dimple formed according to the present invention may be defined by the revolution of a catenary curve about an axis, such as that disclosed in U.S. Pat. Nos. 6,796,912 and 6,729,976, the entire disclosures of which are incorporated by reference herein. In another embodiment, the dimple profiles correspond to polynomial curves, ellipses, spherical curves, saucer-shapes, truncated cones, trigonometric, exponential, or logarithmic curves and flattened trapezoids.

The profile of the dimple may also aid in the design of the aerodynamics of the golf ball. For example, shallow dimple depths, such as those in U.S. Pat. No. 5,566,943, the entire disclosure of which is incorporated by reference herein, may be used to obtain a golf ball with high lift and low drag coefficients. Conversely, a relatively deep dimple depth may aid in obtaining a golf ball with low lift and low drag coefficients.

The dimple profile may also be defined by combining a spherical curve and a different curve, such as a cosine curve, a frequency curve, or a catenary curve, as disclosed in U.S. Patent Publication Nos. 2015/0119171 and 2012/0165130, which are incorporated in their entirety by reference herein. In another embodiment, the dimple profile is defined by combining a cosine curve and a different curve. In another embodiment, the dimple profile is defined by the superposition of a frequency curve and a different curve. In another embodiment, the dimple profile is defined by the superposition of a catenary curve and different curve. In still another embodiment, the dimple profile could result from the superposition of three or more different curves. In yet another embodiment, one or more of the superposed curves could be a functionally weighted curve, as disclosed in U.S. Patent Publication No. 2013/0172123, which is incorporated in its entirety by reference herein.

Golf Ball Construction

The dimples of the present invention may be used with practically any type of ball construction. For instance, the golf ball may have a two-piece design or a double cover construction depending on the type of performance desired of the ball. Other suitable golf ball constructions include solid, wound, liquid-filled, and/or dual cores, and multiple intermediate layers.

Different materials may be used in the construction of the golf balls made with the present invention. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

EXAMPLES

The following non-limiting examples demonstrate plan shapes of golf ball dimples made in accordance with the present invention. The examples are merely illustrative of the preferred embodiments of the present invention, and are not to be construed as limiting the invention, the scope of which is defined by the appended claims.

Example 1

Figure 2:
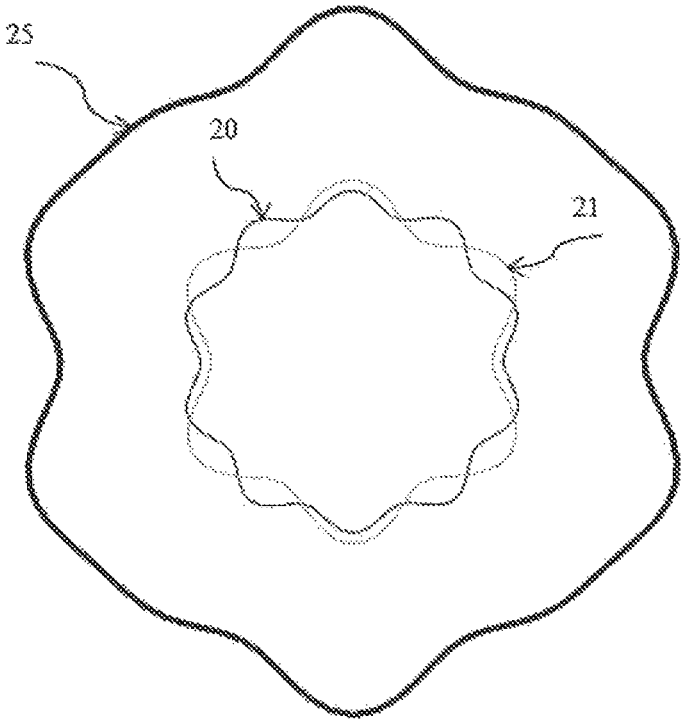
FIG. 2 illustrates a golf ball dimple plan shape defined by the superposition of a ten-point periodic star and a six-point periodic star.

The following example illustrates a golf ball dimple plan shape defined by the superposition of two elements: a ten-point periodic star and a six-point periodic star. FIG. 2 demonstrates each element to be superposed and a golf ball dimple plan shape formed by the superposition of the elements. In particular, FIG. 2 shows a continuous, simple closed ten-point periodic star curve 20 and a continuous, simple closed six-point periodic star curve 21. Curves 20 and 21 have 1:1 aspect ratios in the x-y plane. By using the Superposition Principle, curves 20 and 21 are superposed to create an alternative dimple plan shape 25 (represented by bold line) in accordance with the present invention.

Example 2

Figure 3:
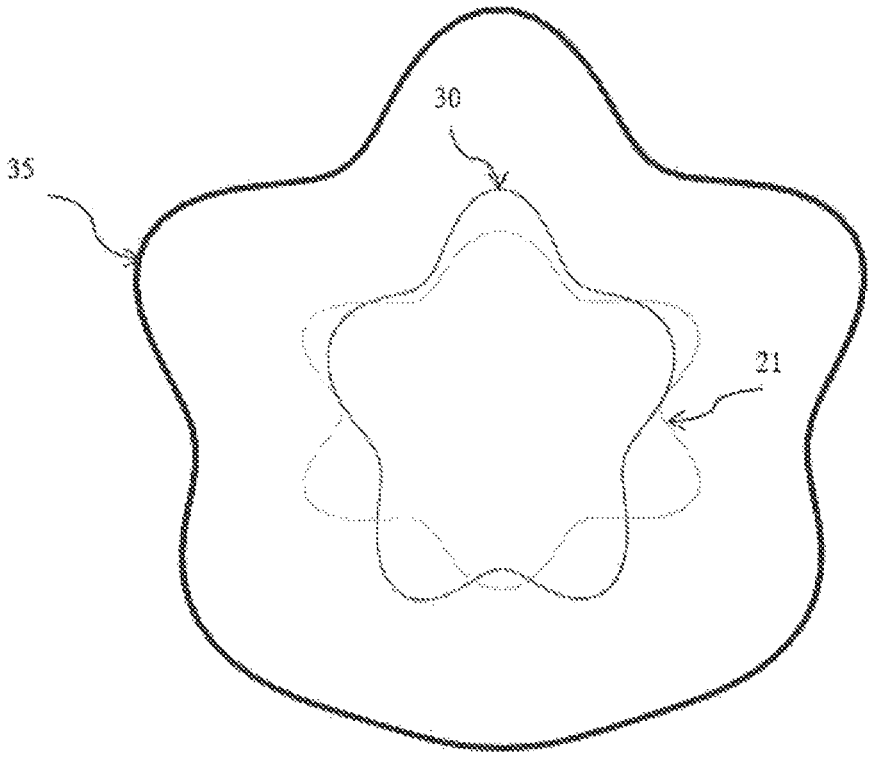
FIG. 3 illustrates a golf ball dimple plan shape defined by the superposition of a five-point periodic star and a six-point periodic star.

The following example illustrates a golf ball dimple plan shape defined by the superposition of two elements: a five-point periodic star and a six-point periodic star. FIG. 3 demonstrates each element to be superposed and a golf ball dimple plan shape formed by the superposition of the elements. In particular, FIG. 3 shows a continuous, simple closed five-point periodic star curve 30 and the continuous, simple closed six-point periodic star curve 21. By using the Superposition Principle, curves 30 and 21 are superposed to create an alternative dimple plan shape 35 (represented by bold line) in accordance with the present invention.

Example 3

Figure 4:
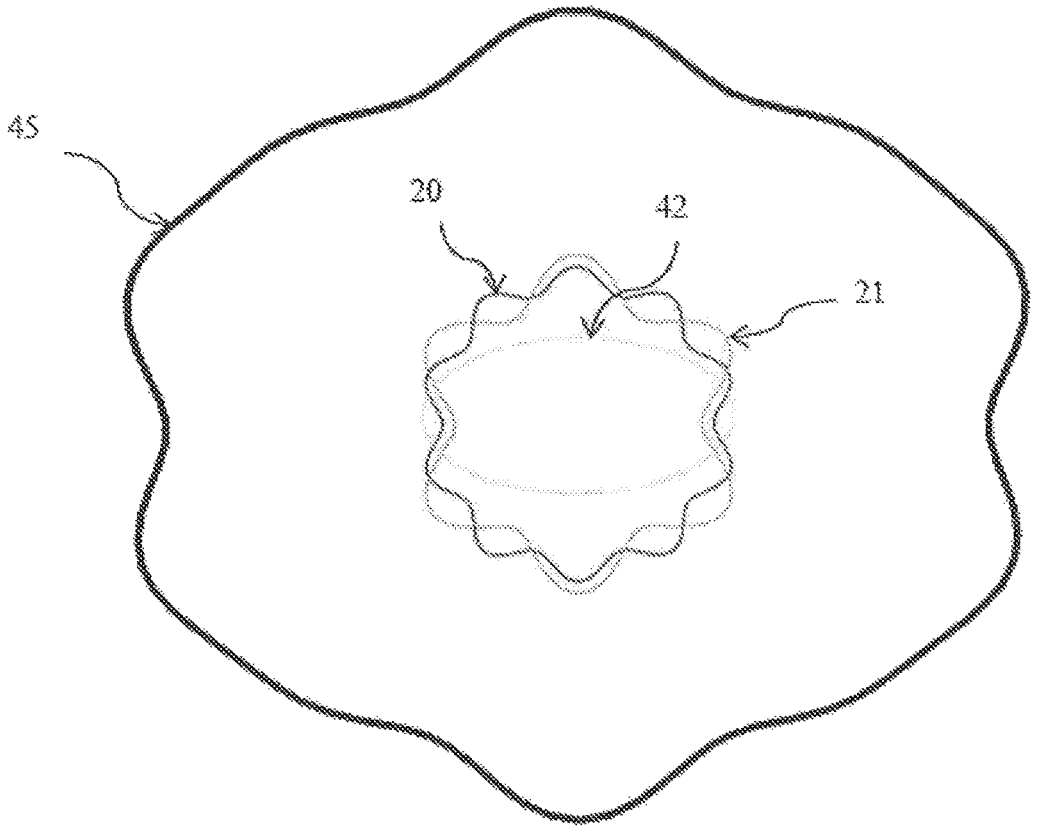
FIG. 4 illustrates a golf ball dimple plan shape defined by the superposition of a ten-point periodic star, a six-point periodic star, and an ellipse.

The following example illustrates a golf ball dimple plan shape defined by the superposition of three elements: a ten-point periodic star, a six-point periodic star, and an ellipse. FIG. 4 demonstrates each element to be superposed and a golf ball dimple plan shape formed by the superposition of the elements. In particular, FIG. 4 shows the continuous, simple closed ten-point periodic star curve 20, the continuous, simple closed six-point periodic star curve 21, and a simple closed elliptical curve 42. By using the Superposition Principle, curves 20, 21, and 42 are superposed to create an alternative dimple plan shape 45 (represented by bold line) in accordance with the present invention.

Example 4

Figure 5:
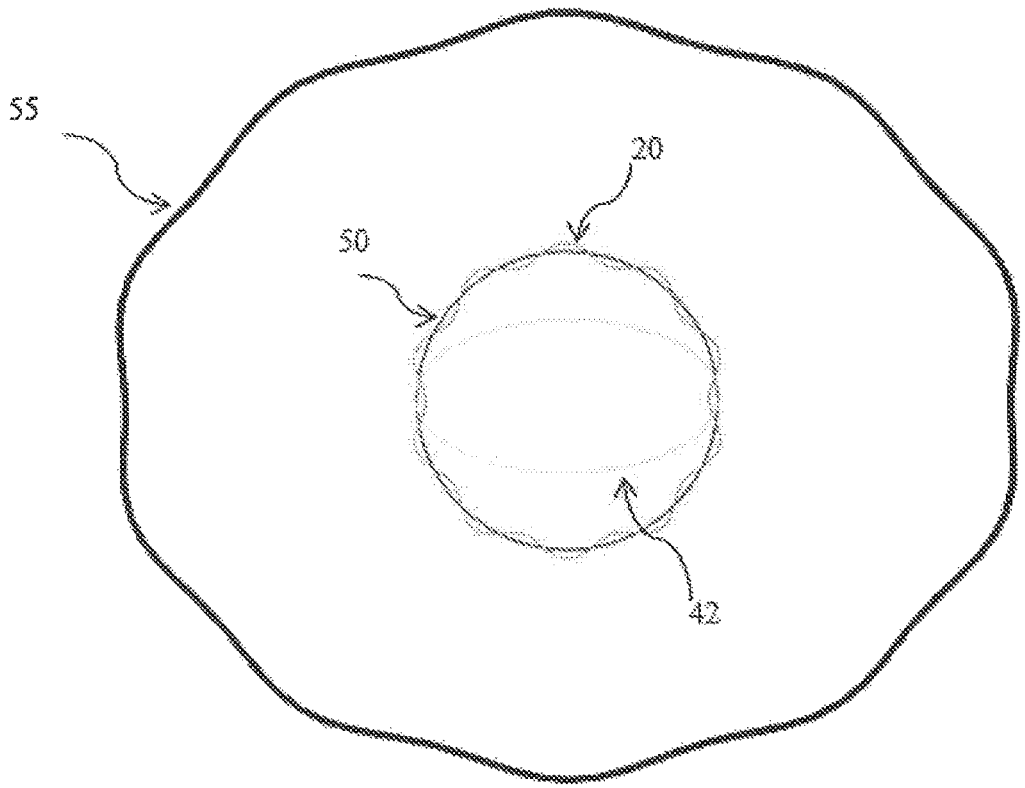
FIG. 5 illustrates a golf ball dimple plan shape defined by the superposition of a circle, ten-point periodic star, and an ellipse.

The following example illustrates a golf ball dimple plan shape defined by the superposition of three elements: a circle, a ten-point periodic star, and an ellipse. FIG. 5 demonstrates each element to be superposed and a golf ball dimple plan shape formed by the superposition of the elements. In particular, FIG. 5 shows a continuous, simple closed circular curve 50, the continuous, simple closed ten-point periodic star curve 20, and the simple closed elliptical curve 42. By using the Superposition Principle, curves 50, 20, and 42 are superposed to create an alternative dimple plan shape 55 (represented by bold line) in accordance with the present invention.

Example 5

Figure 6:
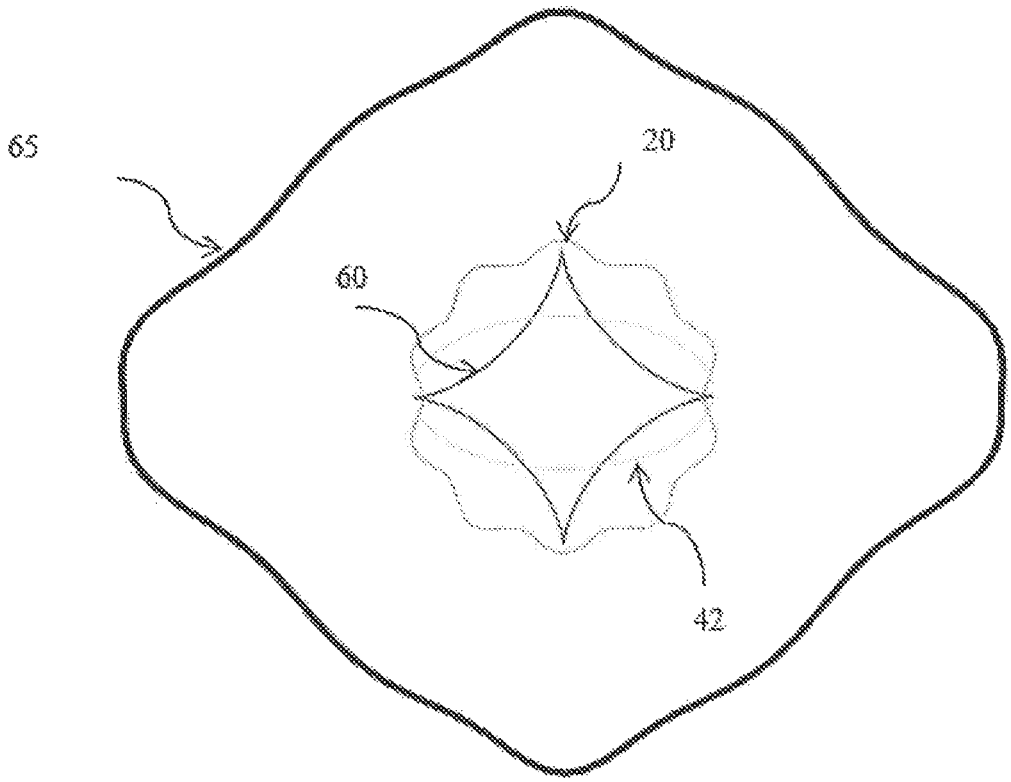
FIG. 6 illustrates a golf ball dimple plan shape defined by the superposition of an asteroid curve, a ten-point periodic star, and an ellipse.

The following example illustrates a golf ball dimple plan shape defined by the superposition of three elements: an asteroid curve, a ten-point periodic star, and an ellipse. FIG. 6 demonstrates each element to be superposed and a golf ball dimple plan shape formed by the superposition of the elements. In particular, FIG. 6 shows a continuous, simple closed asteroid curve 60, the continuous, simple closed ten-point periodic star curve 20, and the simple closed elliptical curve 42. By using the Superposition Principle, curves 60, 20, and 42 are superposed to create an alternative dimple plan shape 65 (represented by bold line) in accordance with the present invention.

Example 6

Figure 7:
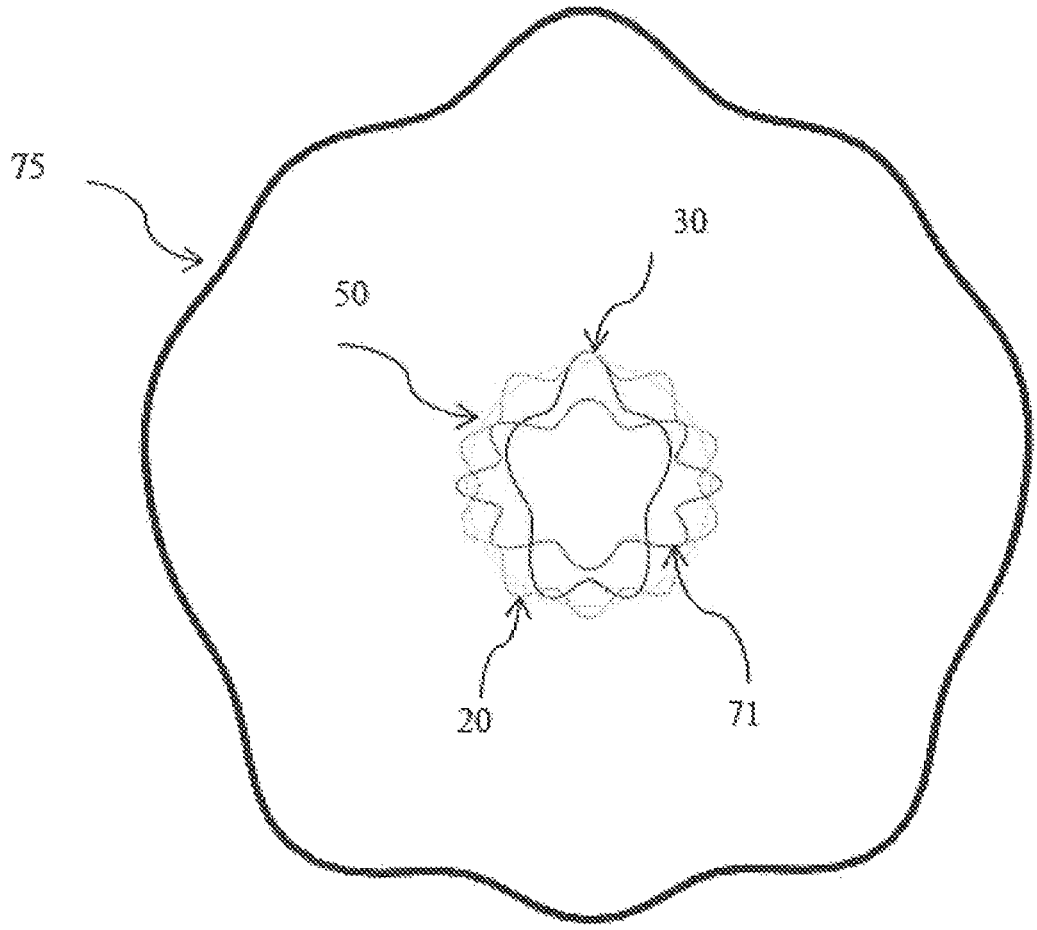
FIG. 7 illustrates a golf ball dimple plan shape defined by the superposition of a five-point periodic star, eight-point periodic star, a circle, and a ten-point periodic star.

The following example illustrates a golf ball dimple plan shape defined by the superposition of four elements: a five-point periodic star, an eight-point periodic star, a circle, and a ten-point periodic star. FIG. 7 demonstrates each element to be superposed and a golf ball dimple plan shape formed by the superposition of the elements. In particular, FIG. 7 shows the continuous, simple closed five-point periodic star curve 30, a continuous, simple closed eight-point periodic star curve 71, the simple closed circular curve 50, and the simple closed ten-point periodic star curve 20. By using the Superposition Principle, curves 30, 71, 50, and 20 are superposed to create an alternative dimple plan shape 75 (represented by bold line) in accordance with the present invention.

Example 7

Figure 8:
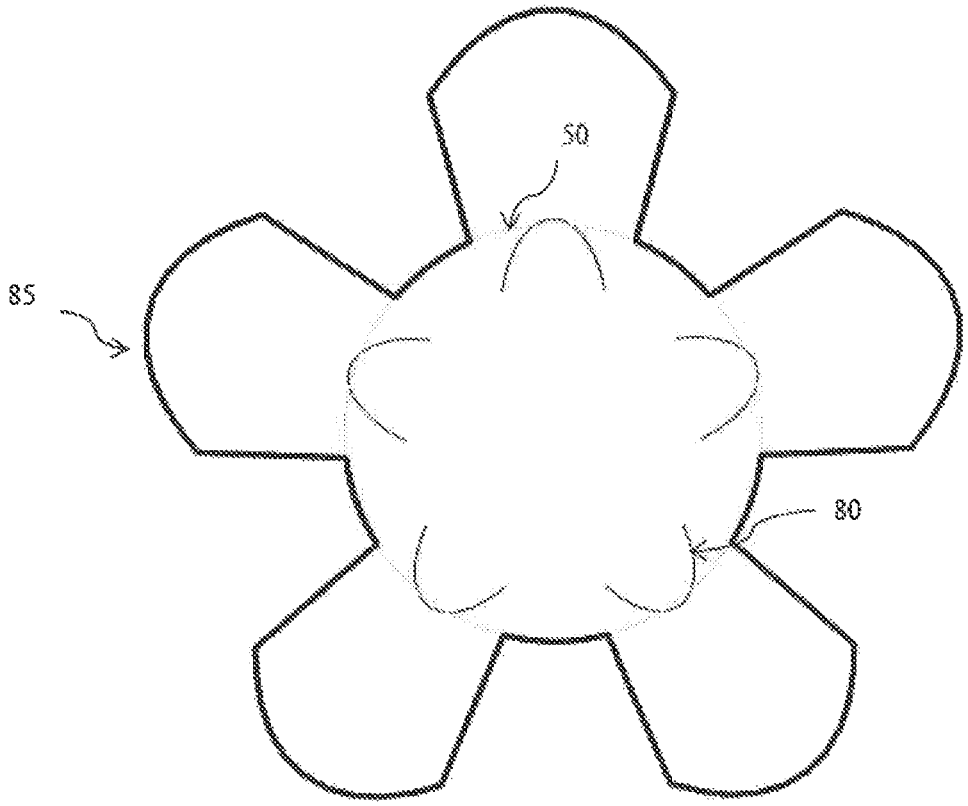
FIG. 8 illustrates a golf ball dimple plan shape defined by the superposition of a five-point discontinuous star and a circle.

The following example illustrates a golf ball dimple plan shape defined by the superposition of two elements: a five-point discontinuous star and a circle. FIG. 8 demonstrates each element to be superposed and a golf ball dimple plan shape formed by the superposition of the elements. In particular, FIG. 8 shows a five-point discontinuous star curve 80 and the continuous, simple closed circular curve 50. No scaling is required. By using the Superposition Principle, curves 80 and 50 are superposed to create an alternative dimple plan shape 85 (represented by bold line) in accordance with the present invention.

Example 8

Figure 9A:
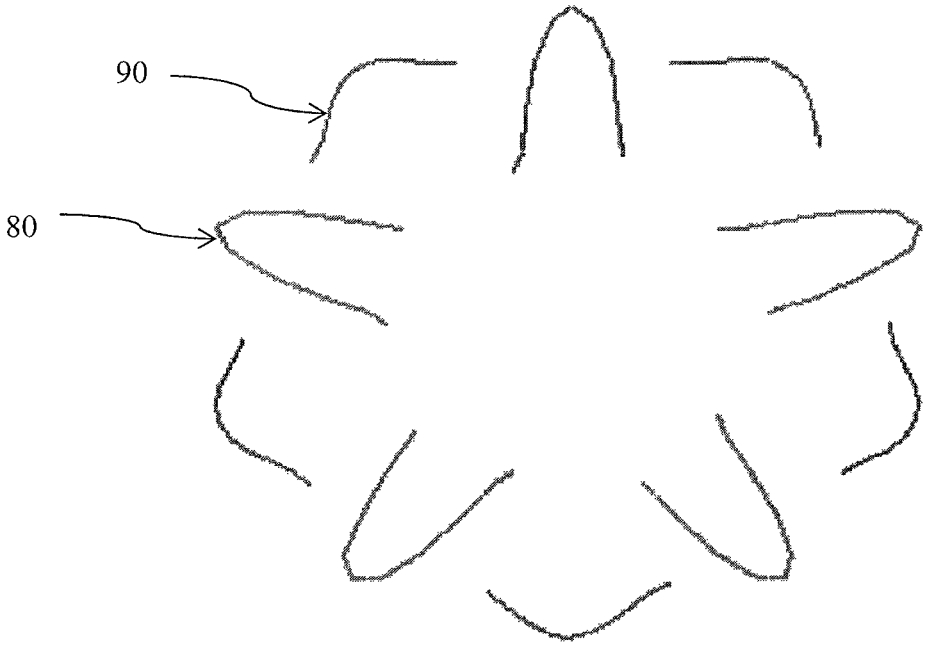
FIG. 9A illustrates a five-point discontinuous star and a discontinuous pentagon.
Figure 9B:
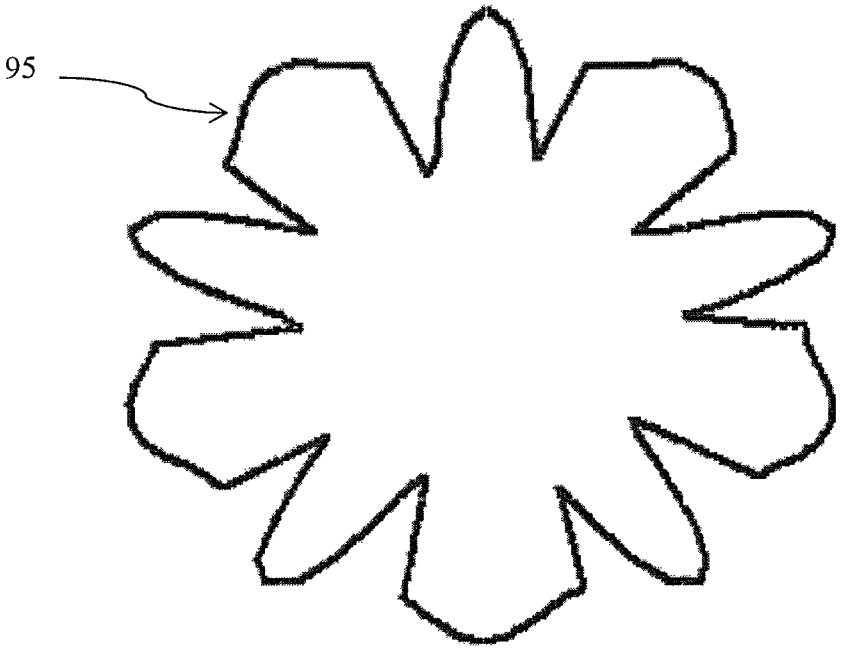
FIG. 9B illustrates a golf ball dimple plan shape defined by the superposition of a five-point discontinuous star and a discontinuous pentagon.

The following example illustrates a golf ball dimple plan shape defined by the superposition of two elements: a five-point discontinuous star and a discontinuous pentagon. FIG. 9A demonstrates each element to be superposed and FIG. 9B demonstrates a golf ball dimple plan shape formed by the superposition of the elements. In particular, FIG. 9A shows the five-point discontinuous star curve 80 and a discontinuous pentagon curve 90. No scaling is required. As shown in FIG. 9B, by using the Superposition Principle, curves 80 and 90 are superposed to create an alternative dimple plan shape 95 (represented by bold line) in accordance with the present invention.

Example 9

The following example illustrates a golf ball dimple plan shape defined by the superposition of two elements: a five-point periodic star and a periodic saw tooth function. FIG. 10A demonstrates each element to be superposed and a golf ball dimple plan shape formed by the superposition of the elements. In particular, FIG. 10A shows the continuous, simple closed five-point periodic star curve 30 and a continuous, simple closed periodic saw tooth function curve 100. By using the Superposition Principle, curves 30 and 100 are superposed to create an alternative dimple plan shape 105 (represented by bold line) in accordance with the present invention. As discussed briefly above, FIG. 10B illustrates a golf ball dimple pattern 110 made up of dimple plan shapes 105.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A golf ball having a substantially spherical surface, comprising:

a plurality of dimples on the spherical surface, wherein at least a portion of the plurality of dimples comprise a non-circular plan shape defined by the superposition of at least a first element and a second element, wherein each of the first element and the second element is continuous and has a simple closed path, wherein the non-circular plan shape is the sum of the first element and the second element; wherein the first and second elements are different types of plane curves, each type being selected from the group consisting of circular curves, elliptical curves, polygonal curves, periodic curves, algebraic polar curves, and astroid curves; and wherein the first and second elements maintain a central axis that is coincident with the center of a dimple.

2. The golf ball of claim 1, wherein at least a portion comprises about 50 percent or more of the dimples on the golf ball.

3. A golf ball having a substantially spherical surface, comprising:

a plurality of dimples on the spherical surface, wherein at least a portion of the plurality of dimples comprise a non-circular plan shape defined by the superposition of three or more different types of curves, each type of curve being selected from the group consisting of circular curves, elliptical curves, polygonal curves, periodic curves, algebraic polar curves, and astroid curves; wherein the non-circular plan shape is the sum of the three or more different curves, wherein each of the three or more different curves is continuous and has a simple closed path; and wherein the curves maintain a central axis that is coincident with the center of a dimple.

4. The golf ball of claim 3, wherein the non-circular plan shape is defined by the superposition of an elliptical curve, a periodic curve, and an astroid curve.

5. The golf ball of claim 3, wherein at least a portion comprises about 70 percent or more of the dimples on the golf ball.

* * * * *